US005663716A

United States Patent [19]

Miwa et al.

[11] Patent Number: 5,663,716

[45] Date of Patent: Sep. 2, 1997

[54] METHOD OF AVOIDING SIGNAL INTERFERENCE AMONG A PLURALITY OF REMOTE CONTROL SIGNALS

[75] Inventors: Kenichi Miwa; Ryo Okamura, both of Tokyo, Japan

[73] Assignee: SMK Corporation, Tokyo, Japan

[21] Appl. No.: 385,427

[22] Filed: Feb. 8, 1995

[30] Foreign Application Priority Data

Apr. 8, 1994 [JP] Japan ..... 6-070546

[51] Int. Cl.[6] ..... G08C 17/02

[52] U.S. Cl. ..... 340/825.04; 348/734; 340/825.69; 340/825.72; 340/825.53

[58] Field of Search ..... 340/825.04, 825.53, 340/825.63, 825.69, 825.72; 348/734; 359/135, 140, 142, 146; 364/143; 370/77, 82, 348, 498, 522, 314

[56] References Cited

U.S. PATENT DOCUMENTS 4,835,614 5/1989 Ryu ..... 348/734
4,931,790 6/1990 Kobayashi et al. ..... 340/825.72
5,227,775 7/1993 Bruckert et al. ..... 340/825.25
5,331,450 7/1994 Heep et al. ..... 340/825.53

*Primary Examiner*—Michael Horabik
*Assistant Examiner*—William H. Wilson, Jr.
*Attorney, Agent, or Firm*—Nikaido Marmelstein Murray & Oram LLP

[57] ABSTRACT

A transmitting and receiving system includes two or more remote controls and a single receiver, which a machine or apparatus to be controlled is equipped with. Each remote control has a proper number "i" allotted thereto, and is capable of sending a control signal to the machine or apparatus. The repetitive period ST of transmission is composed of a transmission permitting data frame STa and a transmission preventing data frame STb, provided that the transmission permitting data frame Sta is equal to or shorter than the transmission preventing data frame STb (STa≦STb). The transmission permitting data frame STa is determined by multiplying a given transmission unit of time TT by $2^{i-1}$. The transmission unit of time TT is composed of a data present sub-section DTa and a data absent sub-section DTb, provided that data-present sub-section DTa is equal to or shorter than data-absent sub-section DTb (DTa≦DTb).

4 Claims, 10 Drawing Sheets

Number of TTs (i=2)

DTa (Frame structure)

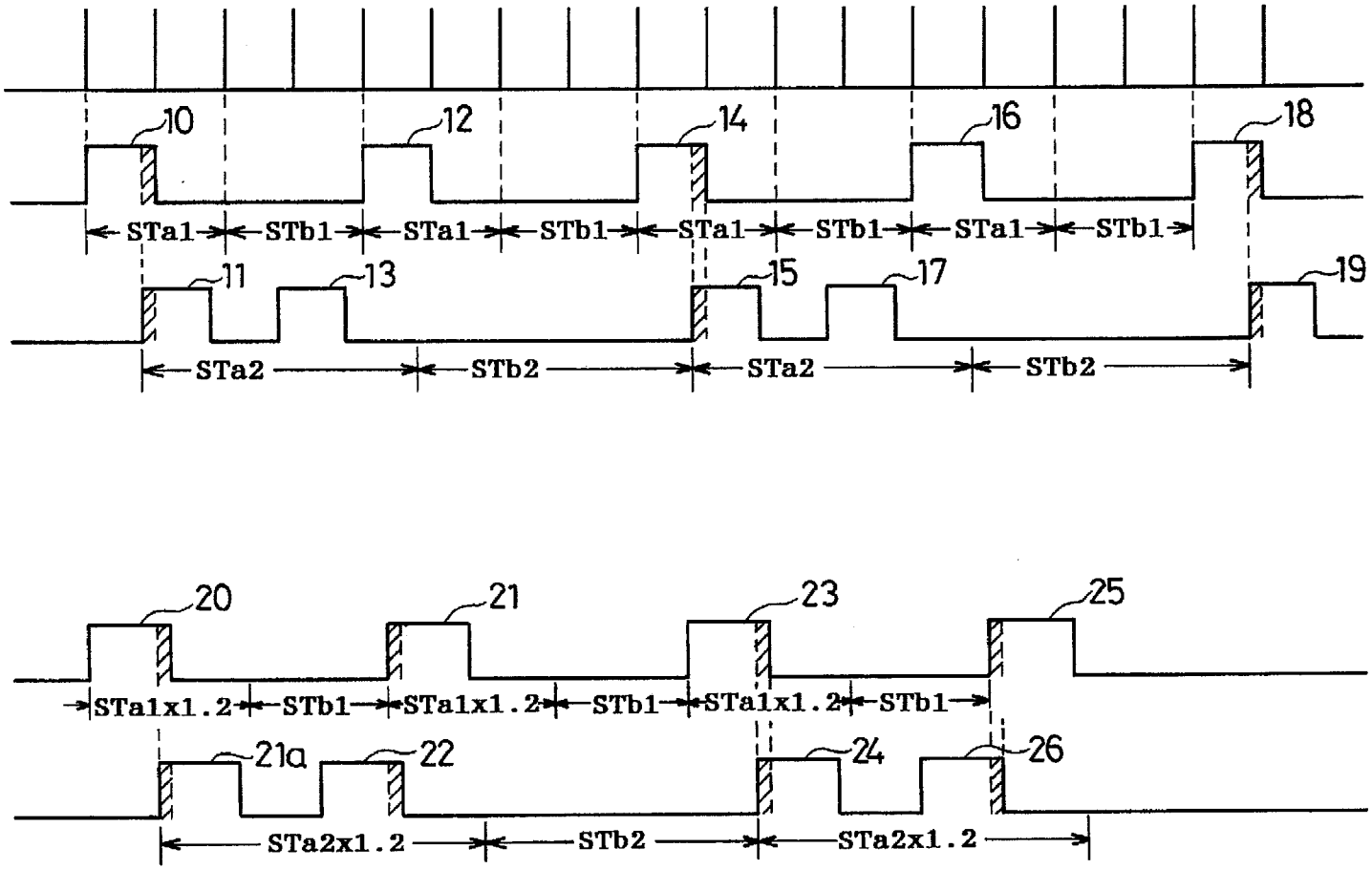
FIG. 3A Channel 1
FIG. 3B Channel 2
FIG. 4A Channel 1A
FIG. 4B Channel 2A

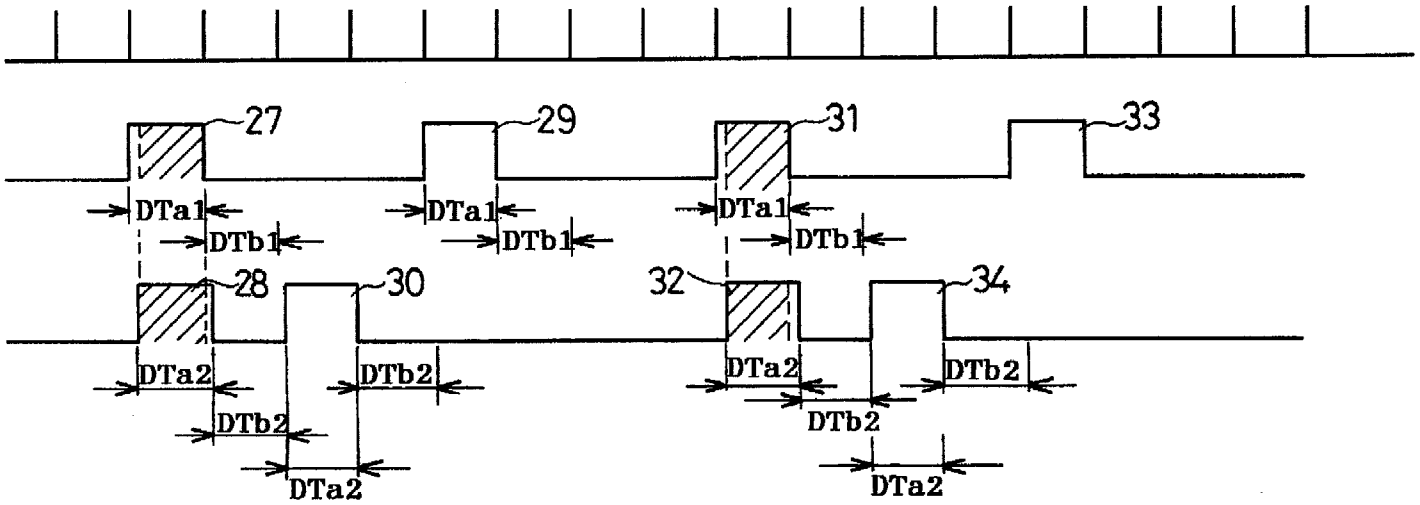
FIG. 5A Channel 1
FIG. 5B Channel 2

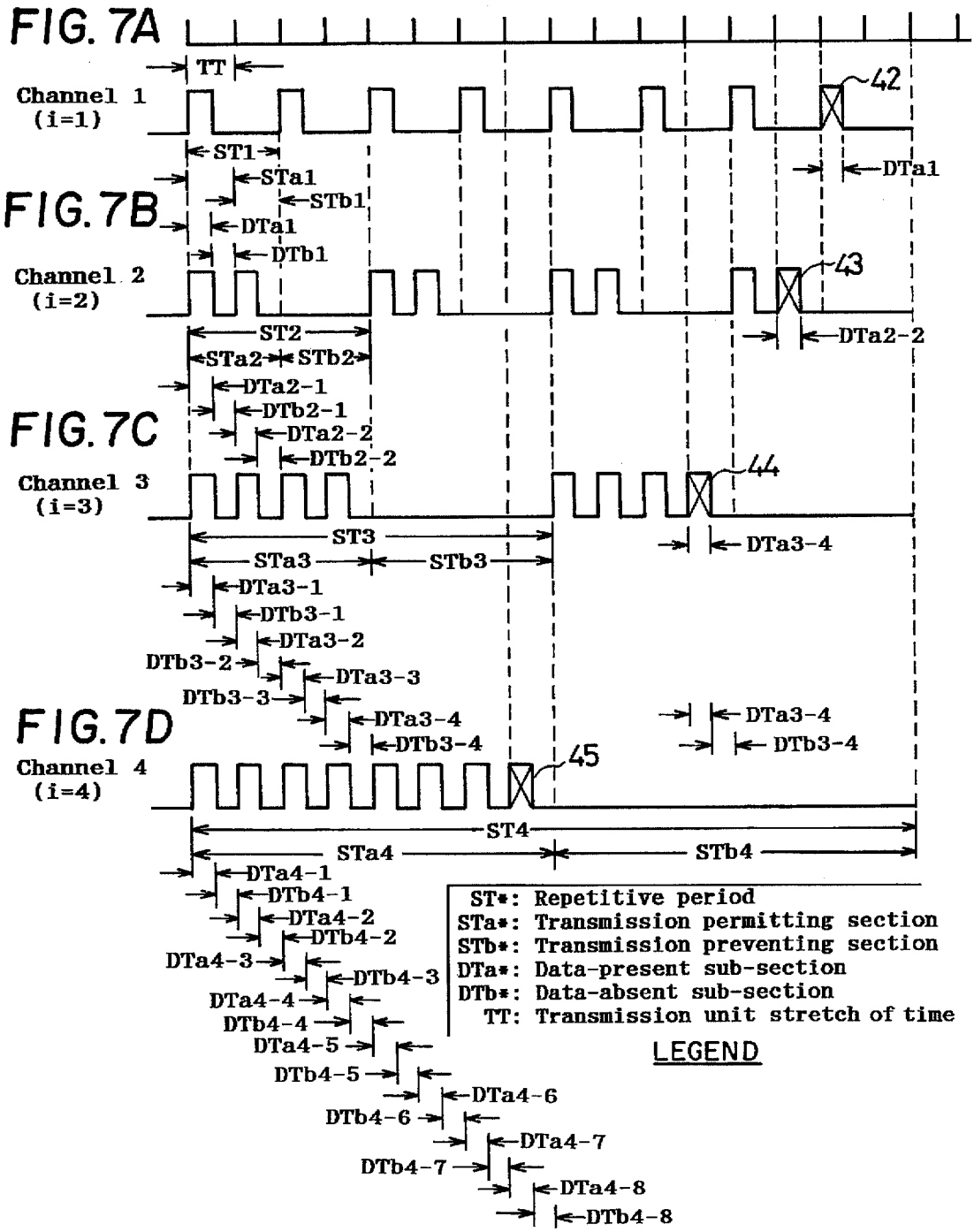
FIG. 7A
FIG. 7B
FIG. 7C
FIG. 7D
TT
Channel 1 (i=1)
42
ST1
STa1
STb1
DTa1
DTb1
DTa1
Channel 2 (i=2)
43
ST2
STa2
STb2
DTa2-1
DTb2-1
DTa2-2
DTb2-2
DTa2-2
Channel 3 (i=3)
44
ST3
STa3
STb3
DTa3-1
DTb3-1
DTa3-2
DTb3-2
DTa3-3
DTb3-3
DTa3-4
DTb3-4
DTa3-4
DTb3-4
Channel 4 (i=4)
45
ST4
STa4
STb4
DTa4-1
DTb4-1
DTa4-2
DTb4-2
DTa4-3
DTb4-3
DTa4-4
DTb4-4
DTa4-5
DTb4-5
DTa4-6
DTb4-6
DTa4-7
DTb4-7
DTa4-8
DTb4-8
ST*: Repetitive period
STa*: Transmission permitting section
STb*: Transmission preventing section
DTa*: Data-present sub-section
DTb*: Data-absent sub-section
TT: Transmission unit stretch of time
LEGEND

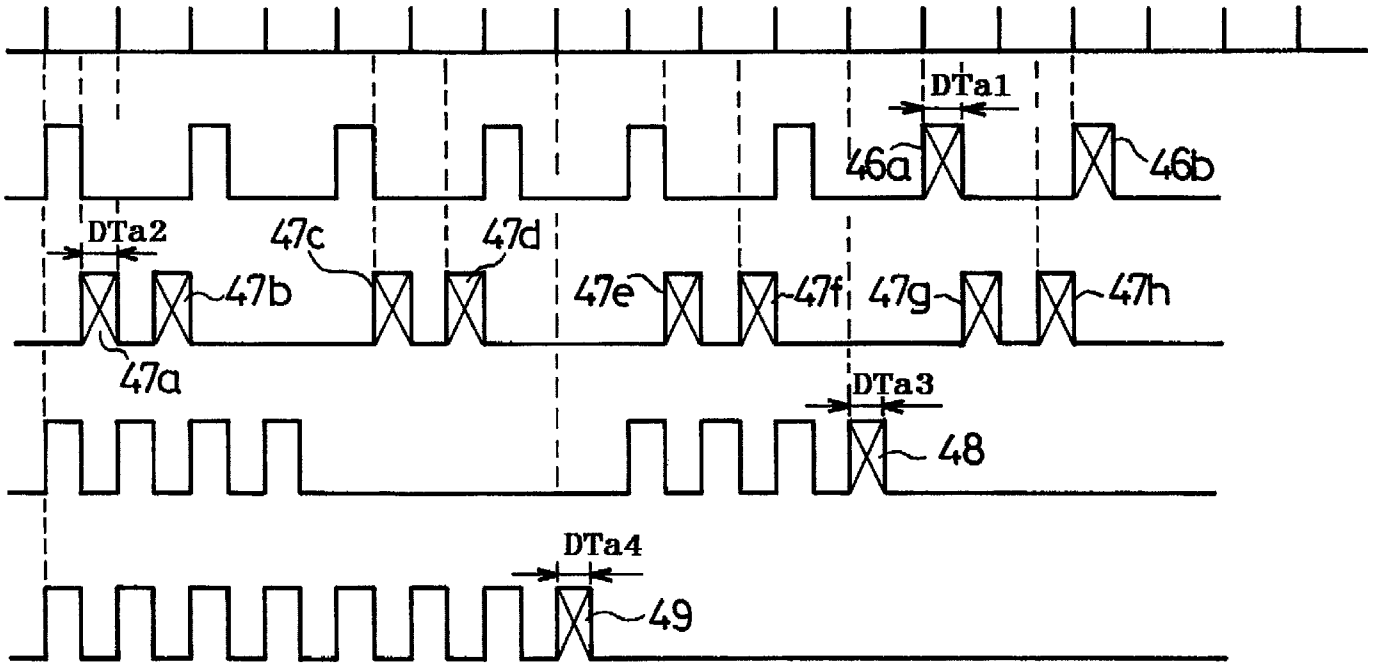
FIG. 8A Channel 1 (i=1)
FIG. 8B Channel 2 (i=2)
FIG. 8C Channel 3 (i=3)
FIG. 8D Channel 4 (i=4)

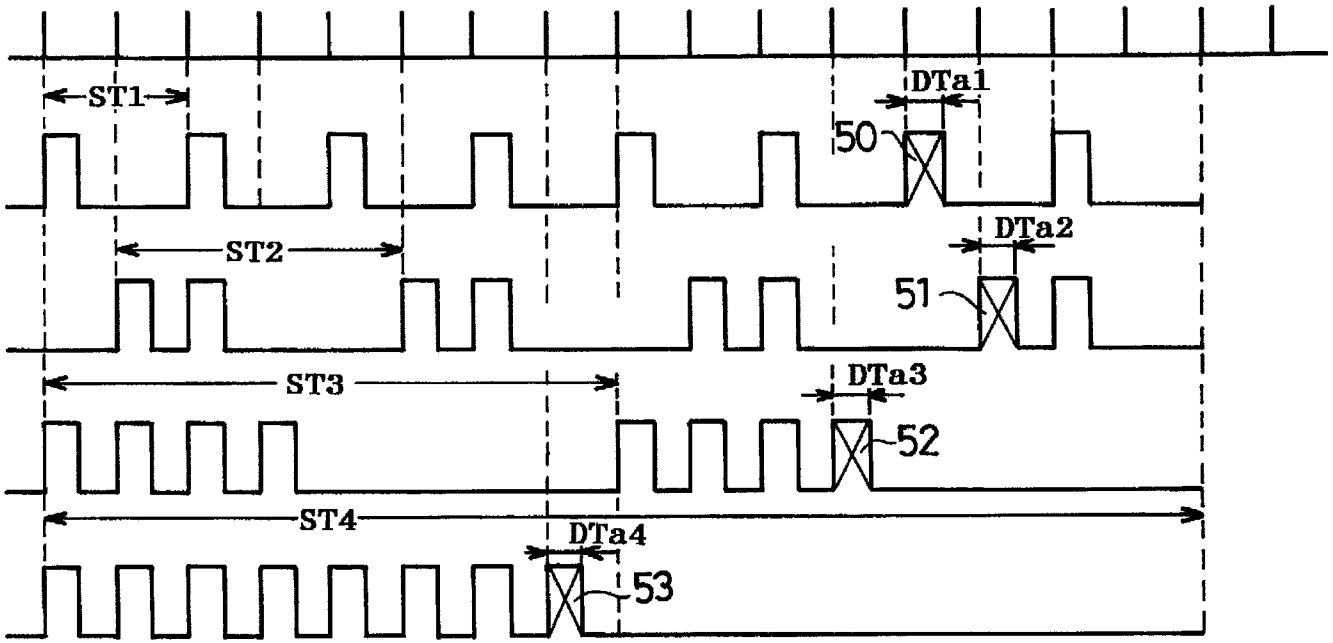
FIG. 9A Channel 1 (i=1)
FIG. 9B Channel 2 (i=2)
FIG. 9C Channel 3 (i=3)
FIG. 9D Channel 4 (i=4)

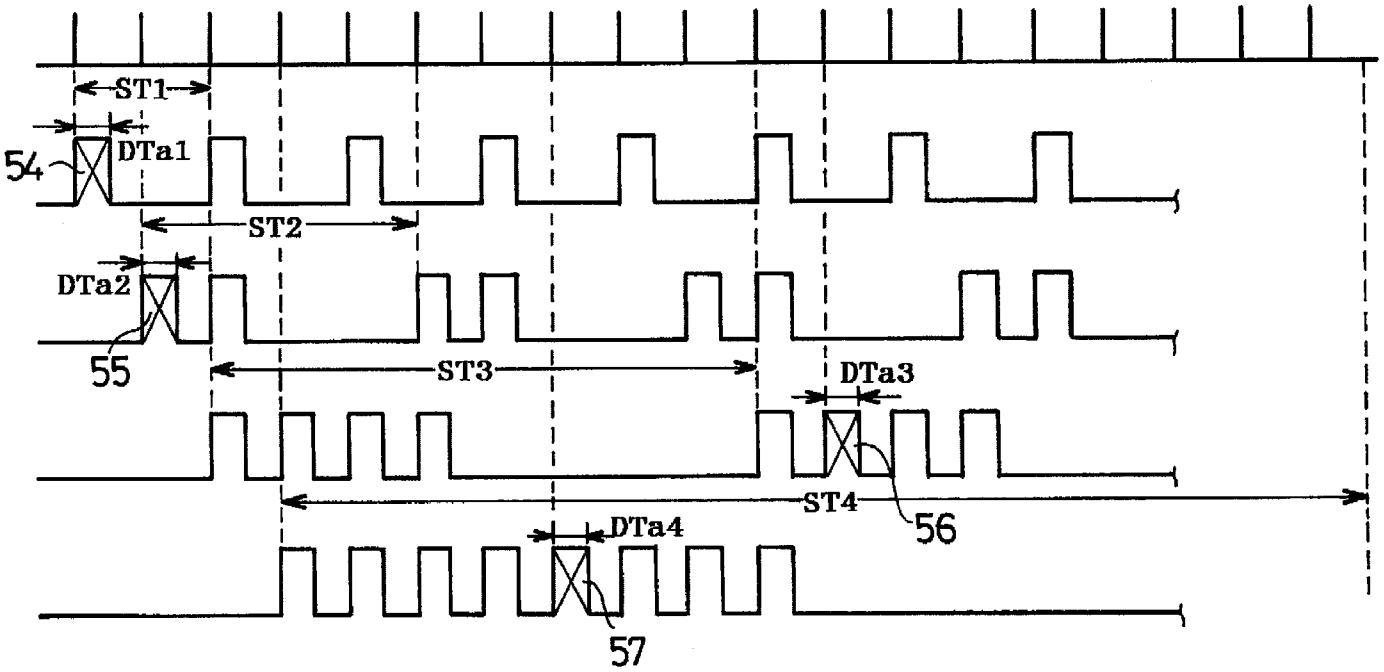
FIG. 10A Channel 1 (i=1)
FIG. 10B Channel 2 (i=2)
FIG. 10C Channel 3 (i=3)
FIG. 10D Channel 4 (i=4)

58
DTa1
59
DTa2
60
DTa3
61
DTa4
62
DTa5
ST1
ST2
ST3
ST4
ST5

Channel 1

Channel 2

Channel 3

Channel 4

Channel 5

METHOD OF AVOIDING SIGNAL INTERFERENCE AMONG A PLURALITY OF REMOTE CONTROL SIGNALS

BACKGROUND OF THE INVENTION

1. Field of the Invention

The present invention relates to a transmitting and receiving system in which a plurality of remote controls transmit infrared rays, electromagnetic waves, supersonic waves or other energetic signals of the same frequency are transmitted simultaneously to a single receiver in the same place.

In general, when machines or apparatuses are controlled from a distant place, these machines or apparatuses are equipped with receivers, and associated remote controls have means to perform wired communication or wireless communication with the machines or apparatuses by using infrared rays, electromagnetic waves, supersonic waves or other energies.

Such a remote control comprises means to permit command data to be manually or automatically input, means to modulate a carrier wave with the command data and means to transmit the so modulated carrier wave to an associated machine or apparatus through a given communication link or channel.

The receiver of the associated machine or apparatus receives the signal bearing command data to demodulate it and derive the command data for working accordingly. 2. Description of Related Art In a conventional remote control analogue signals are sampled and quantized to be converted to digital signals, which are given in the form of frames, each composed of 16 to 32 bits, and then control data thus provided are transmitted at regular intervals.

There is no problem of interference or cross talk if a single remote control is used. Even if a plurality of remote controls are used, there is no problem of interference or cross talk as long as each remote control is used at a different time.

Recently there has been an increasing demand for simultaneous use of two or more remote controls to control a single machine or apparatus in the same place. In this case it is most important to prevent any Interference or cross talk between signals transmitted from different remote controls.

Such interference or cross talk is most likely to appear, if some remote controls send simultaneously signals of the same frequency at the same intervals in the same place, and then the signals from the remote controls will be mixed at the receiver of the machine or apparatus. Command data received there cannot be correctly interpreted, thereby causing malfunctions in the machine or apparatus.

In an attempt to reduce such interference or cross talk a different frequency is allotted to each remote control (multifrequency system), or the single machine or apparatus on the receiving side polls a plurality of remote controls to determine which one will communicate with the machine or apparatus next (polling system).

Transmitting and receiving units required in such multifrequency or polling system, however, are complicated in structure, large in size, and expensive.

SUMMARY OF THE INVENTION

One object of the present invention is to provide a remote control which is guaranteed free of any interference or cross talk with other remote controls which send control signals of the same frequency to a single machine or apparatus in a same place.

To attain this object there is provided according to the present invention a transmitting and receiving system comprising a plurality of remote controls and a single receiver, each of the remote controls being capable of sending a transmission signal, a period ST for the transmission signal to be repeatedly sent (referred hereinafter as "repetitive period ST") being composed of a transmission permitting data frame STa and a transmission preventing data frame STb, provided that the transmission permitting data frame STa is equal to or shorter than the transmission preventing data frame STb (STa≦STb); each transmission permitting data frame STa being composed of transmission unit of time TT times $2^{i-1}$, where "i" is a positive integer, which is different for each remote control or channel, each transmission unit of time TT being composed of data-present sub-section DTa and data-absent sub-section DTb, provided that data-present sub-section DTa is equal to or shorter than data-absent sub-section DTb (DTa≦DTb).

Even if different remote controls send transmission signals of the same frequency according to the same protocol, it is assured that some data-present sub-sections DTa in each channel are not disturbed by the transmission signal of the other channels.

The transmission permitting data frame STa may be equal to the transmission preventing data frame STb (STa=STb), and/or data-present sub-section DTa may be equal to data-absent sub-section DTb (DTa=DTb). Then, transmission and non-transmission of time can be so arranged that the preparing of protocols according to which remote controls can transmit signals may be facilitated.

The proper number "i" allotted to each remote control are preferably selected among possible smallest numbers, thereby improving the hitting efficiency of transmission signals.

Other objects of the present invention will be understood from the following description of preferred embodiments of the present invention, which are described with reference to accompanying drawings.

BRIEF DESCRIPTION OF THE DRAWINGS

FIG. 3 shows time charts representing two transmission signals, each having transmission permitting data frame STa equal to the transmission preventing data frame STb (STa=STb);

FIG. 4 shows time charts representing two transmission signals, each having transmission permitting data frame STa shorter than the transmission preventing data framed STb (STa<STb);

FIG. 5 shows time charts representing two transmission signals, each having data-present sub-section DTa equal to data-absent sub-section DTb (DTa=DTb);

FIG. 7 shows time charts representing four simultaneous transmissions;

FIG. 8 shows time charts representing four simultaneous transmissions, one of which ("i"=2) starts one half of the transmission unit of time later than the other transmissions;

FIG. 9 shows time charts representing four simultaneous transmissions, one of which ("i"=2) starts one transmission unit of time TT later than the other transmissions;

FIG. 10 shows time charts representing four simultaneous transmissions, starting one transmission unit of time later than the precedent one.

DESCRIPTION OF THE PREFERRED EMBODIMENTS

Preferred embodiments of the present invention are described in the order of following items:

(1) A Plurality of Remote Controls and a Single Receiver;

(2) Relationship between Repetitive Period ST and Transmission Unit Stretch of Time TT;

(3) Reasons for Setting Transmission Permitting Data Frame STa Shorter Than Transmission Preventing Data Frame STb;

(4) Reasons for Setting Data Present Sub-Section DTa Shorter Than Data Absent Sub-Section DTb; and (5) Examples of Four-Channel Transmission.

Figure 1:
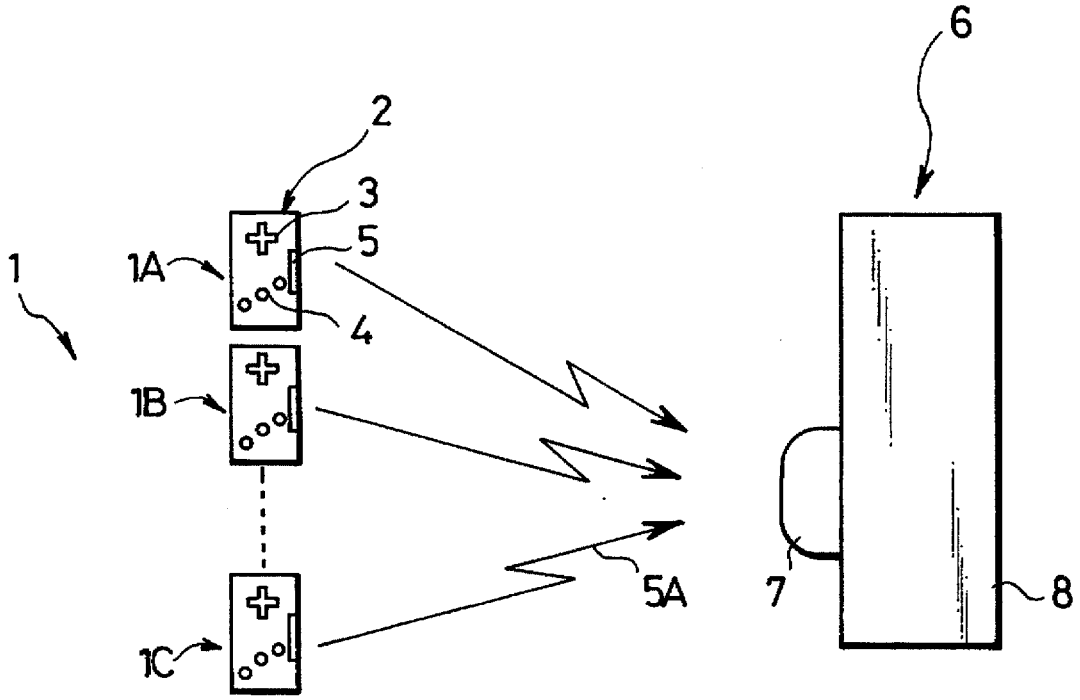
FIG. 1 schematically shows a plurality of remote controls and a single machine or apparatus to which remote controls and machine or apparatus the present invention can be applied.

(1) A Plurality of Remote Controls and a Single Receiver:

Referring to FIG. 1, a transmitting and receiving system comprises a plurality of remote controls 1A, 1B, 1C . . . and a single receiver 7, with which a machine or apparatus 8 is equipped. Each remote control is capable of sending infrared signals to the receiver 7 as indicated at 5A, which is called infrared link or channel hereinafter. The receiver 7 demodulates the received signal to derive command signals according to which the machine or apparatus 8 works.

Each remote control has data inputting means 2 to permit command data to be manually or automatically input, and control means 5 responsive to command data from the data inputting means 2 for providing infrared transmission signals.

The data inputting means 2 includes a cross-shaped push switch 3 for operating the remote machine or apparatus for its normal functions and extra push switches 4 for operating the remote machine or apparatus for its extra functions. It may include additional switches for different purposes.

The control means 5 is designed to rearrange data for infrared transmission, and transmission is effected at controlled intervals, which are set by the data inputting means 2.

The receiver 7 is designed to decode the signal received from a selected remote control for providing the associated machine or apparatus 8 with the command data thus derived. These remote controls 1A, 1B 1C . . . may be operated to form and send transmission signals according to given protocols simultaneously, disadvantageously causing interferences or cross talks therebetween. The transmitting system according to the present invention assures that some data present sub-sections DTa selected among all data present sub-sections DTa in each channel are not disturbed by those of the other channels.

Proper numbers, 1, 2, 3 . . . i . . . are allotted to these remote controls 1A, 1B, 1C . . . The same number should not be allotted to two or more remote controls.

Figures 2A, 2B, 2C:
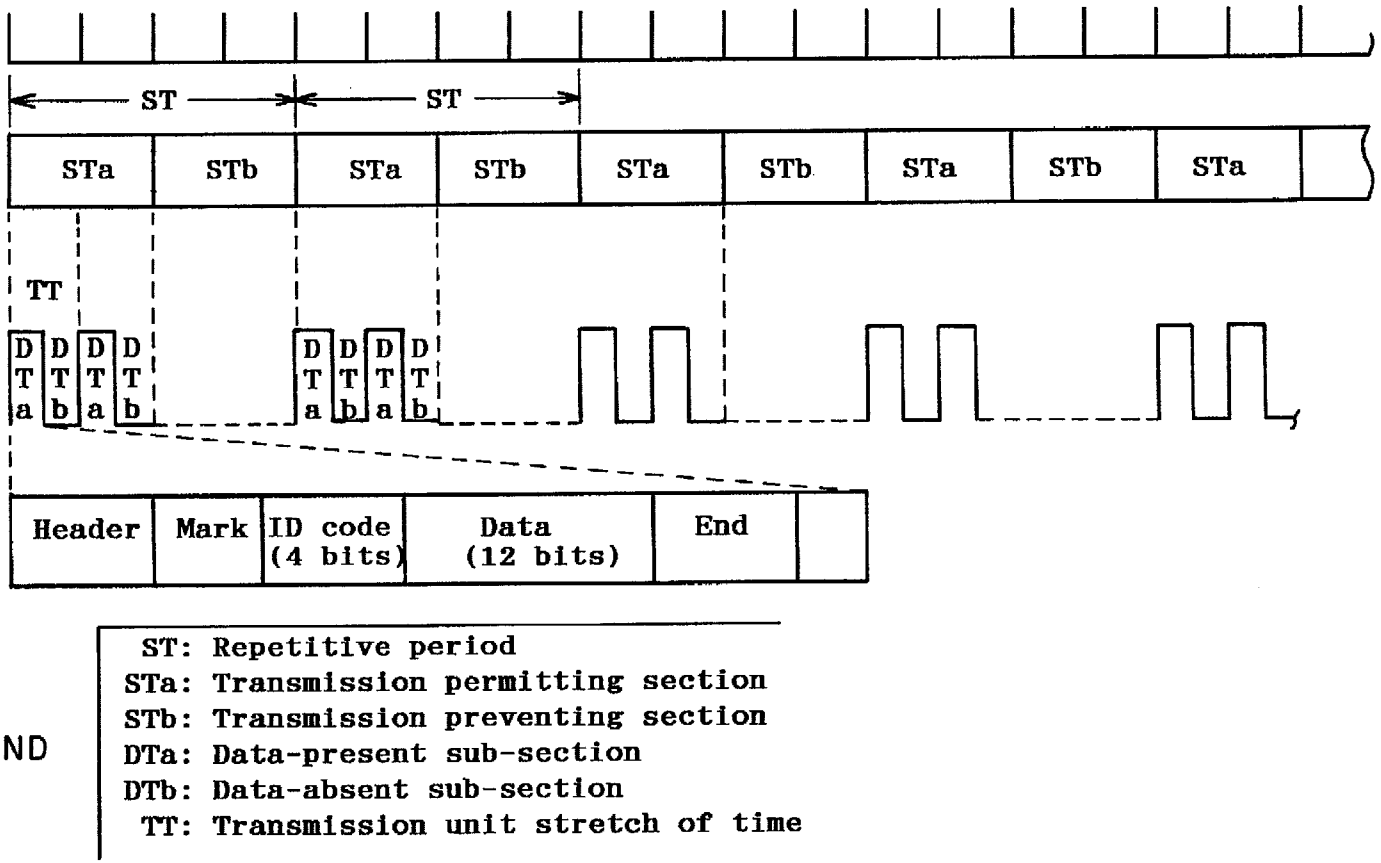
FIG. 2 is a time chart representing a transmission signal from a selected remote control whose proper number "i" is 2.

(2) Relationship between Repetitive Period ST and Transmission Unit of Time TT:

Referring to FIG. 2, a repetitive period ST of the transmission signal is composed of a data frame including a transmission permitting data frame STa and transmission preventing data frame STb, provided that the transmission permitting data frame STa is equal to or shorter than the transmission preventing data frame STb (STa≦STb). In this particular example the transmission permitting data frame STa is set to be equal to the transmission preventing data frame STb (STa=STb) only for the convenience of explanation. The example in which the transmission permitting data frame STa is set to be shorter than the transmission preventing data frame STb (STa<STb) is given in section (3).

Each transmission permitting data frame STa is composed of transmission unit of time TT times $2^{i-1}$, where "i" is a positive integer, which is different for each remote control or transmission channel. Each transmission unit of time TT is composed of data-present sub-section DTa and data-absent sub-section DTb, provided that data-present sub-section DTa is equal to or shorter than data-absent sub-section DTb (DTa≦DTb). In this particular example the data-present sub-section DTa is set to be equal to the data-absent sub-section DTb (DTa=DTb) only for the convenience of explanation. The example in which the data-present sub-section DTa is set to be shorter than the data-absent sub-section DTb (DTa<DTb) is given in section (4).

The data-present sub-section DTa is composed of a single sub-frame which consists of header, mark, ID code (4 bits), data or control data (12 bits) and end. This arrangement may be changed appropriate for a desired purpose.

(3) Reasons for Setting Transmission Permitting Data Frame STa Shorter Than Transmission Preventing Data Frame STb:

Referring to FIG. 3, Channel 1 ("i"=1) is shown for STa1=STb1, whereas Channel 2 ("i"=2) is shown for STa2=STb2. Different proper numbers may be used, provided that the same number should not be allotted to two or more remote controls.

As seen from the drawing, the rising edge of the first transmission permitting data frame STa2 in Channel 2 is coincident with the descending edge of the first transmission permitting data frame STa1 in Channel 1.

In this case in which following relations are satisfied, STa1=STb1 in Channel 1; and STa2=STb2 in Channel 2 (accordingly STa1:STb1=STa2:STb2): data present sub-sections 10, 14 and 18 in Channel 1 interfere with data present sub-sections 11, 15 and 19 in Channel 2, but data present sub-sections 12 and 16 in Channel 1 and data present sub-sections 13 and 17 in Channel 2 are free of interference.

Referring to FIG. 4, in Channel 1A the transmission permitting data frame is longer than the transmission preventing data frame (that is, STa1×1.2>STb1), and similarly in Channel 2A the transmission permitting data frame is longer than the transmission preventing data frames (that is, STa2×1.2>STb2). The Channel 2A-to-Channel 2B relationship is defined by [(STa1×1.2):STb1=(STa2×1.2):STb2]. In this case signals both in Channels 1A and 2A interfere with each other, thereby preventing no command data to be derived on the receiving side.

Specifically, assume that the descending edge of the data present sub-section 20 of the first transmission permitting section STa1×1.2. in Channel 1A is coincident with the rising edge of the first data present sub-section 21 of the first transmission permitting data frame STa2×1.2 in Channel 2A (see hatching). Then, the rising edge of the data present sub-section 21 of the second transmission permitting data frame STa1×1.2 in Channel 1A is coincident with the descending edge of the second data present sub-data frame 22 of the first transmission permitting data frame STa2×1.2 in Channel 2A (see hatching). The same situation appears repeatedly in subsequent data present sub-sections 23, 24, 25, 26 . . . both in Channels 1A and 2A (see hatching), thus preventing no command data to be derived on the receiving side. As seen from this, the transmission permitting data frame STa must be selected to be equal to or shorter than the transmission preventing data frame STb (STa≦STb) because otherwise, interference or cross talk could not be avoided.

(4) Reasons for Setting Data Present Sub-Section DTa Shorter Than Data Absent Sub-Section DTb:

As for Channel 1 it is assumed that data present sub-section DTa1 is set to be equal to data absent sub-section DTb1, and that the allotted proper number "i" is 1.

As for Channel 2 it is assumed that data present sub-section DTa2 is set to be equal to data absent sub-section DTb2, and that the allotted proper number "i" is 2.

Referring to FIG. 5, Channels 1 and 2 are shown for DTa1=DTb1, and the transmission in Channel 2 is shown as being so delayed relative to the transmission in Channel 1 as to cause interference therebetween.

Specifically, data present sub-sections 27, 28, 31 and 32 in Channels 1 and 2 interfere with each other, but data present sub-sections 29, 30, 33 and 34 in Channels 1 and 2 do not interfere with each other, thereby permitting command data to be derived therefrom.

Figures 6A, 6B:
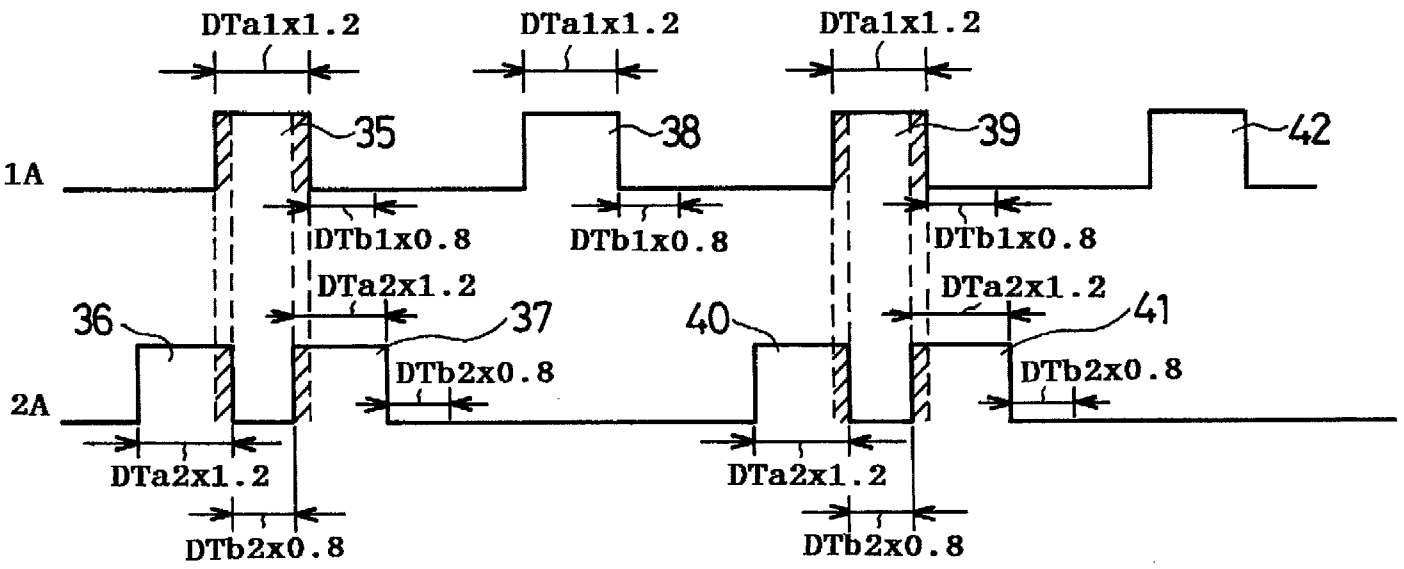
FIG. 6 shows time charts representing two transmission signals, each having data-present sub-section DTa shorter than data-absent sub-section DTb (DTa<DTb)

In contrast, referring to FIG. 6, Channels 1A and 2A are shown for DTa>DTb. The proper number 1 is allotted to Channel 1A, and data present sub-section is longer than data absent sub-section (that is, DTa1×1.2>DTb1×0.8) in Channel 1A.

The proper number 2 is allotted to Channel 2A, and data present sub-section is longer than data absent sub-section (that is, DTa1×1.2>DTb1×0.8) in Channel 2A.

The Channel 1A-to-Channel 2A relationship is defined by [(DTa1×1.2):(DTb1×0.8)=(DTa2×1.2):(DTb2×0.8)].

Here, it should be noted that data present sub-sections DTa1×1.2 and DTa2×1.2 are longer than data present sub-sections DTa1 and DTa2, and that data absent sub-sections DTb1×0.8 and DTb2×0.8 are shorter than data absent sub-sections DTb1 and DTb2.

As seen from FIG. 6, the data present sub-section 35 in Channel 1A is so sandwiched between the data present sub-sections 36 and 37 in Channel 2A that these data present sub-sections interfere with the data present sub-section 35.

The data present sub-section 38 of DTa1×1.2 in Channel 1A remains free of interference, thus permitting command data to be derived therefrom. The data present sub-section 39 of DTa1×1.2 in Channel 1A interfers with the data present sub-sections 40 and 41 of DTa2×1.2 in channel 2A, thus preventing command data from being derived therefrom. The subsequent data present sub-section 42 of DTa1×1.2 in Channel 1A is free of interference, thus permitting command data to be derived therefrom.

As seen from the drawing, there are interference-free data present sub-sections in Channel 1A, thereby permitting command data to be derived in Channel 1A, but there are no interference-free data present sub-sections in Channel 2A, thus preventing command data from being derived in Channel 2A.

As seen from this, data-present sub-section DTa must be selected to be equal to or shorter than data-absent sub-section DTb (that is, DTa≦DTb).

(5) Examples of Four-Channel Transmission.

Each of four remote controls for a four-channel transmission system has a proper number "i" allotted thereto. Each remote control is permitted to send data signals in $2^{i-1}$·data present sub-section (DTa) in the transmission permitting data frame STa, whose stretch of time is determined by the transmission unit of time (TT)×$2^{i-1}$; and is prevented from sending data signals in the transmission preventing data frame STb whose time is equal to the transmission permitting data frame STa.

Assume that: a proper number "1" is allotted to the first remote control; a proper number "2" is allotted to the second remote control, a proper number "3" is allotted to the third remote control; and a proper number "4" is allotted to the fourth remote control.

Referring to FIG. 7, as for the first remote control for Channel 1 ("i"=1), the transmission permitting data frame STa1 is equal to the transmission unit of time (TT)×$2^{i-1}$, that is, TT×1, and the transmission permitting data frame STa1 contains $2^{i-1}$·data present sub-section DTa1. Thus, a single data present sub-section DTa1 is contained in the transmission permitting data frame STa1. A single repetitive period is composed of the transmission permitting data frame STa1 and the transmission preventing data frame STb1, which is equal to the transmission permitting data frame STa1.

As for the second remote control for Channel 2 ("i"=2), the transmission permitting data frame STa2 is equal to the transmission unit of time (TT)×$2^{i-1}$, that is, TT×2, and the transmission permitting data frame STa2 contains $2^{i-1}$·data present sub-section DTa2. Thus, two data present sub-sections DTa2-1 and DTa2-2 are contained in the transmission permitting data frame STa2. A single repetitive period ST2 is composed of the transmission permitting data frame STa2 and the transmission preventing data frame STb2, which is equal to the transmission permitting data frame STa2.

As for the third remote control for Channel 3 ("i"=3), the transmission permitting data frame STa3 is TT×$2^2$ long, that is, TT×4 long, and it contains $2^2$·data present sub-section DTa3, that is, DTa3-1, DTa3-2, DTa3-3 and DTa3-4. A single repetitive period ST3 is TT×8 long.

Finally as for the fourth remote control for Channel 4 ("i"=4), the transmission permitting data frame STa4 is TT×$2^3$ long, that is, TT×8 long, and eight data present sub-sections DTa4 (DTa4-1, DTa4-2, DTa4-3, DTa4-4, DTa4-5, DTa4-6, DTa4-7 and DTa4-8) are contained in the transmission permitting data frame STa4. A single repetitive period ST4 is TT×16 long.

Different proper numbers can be allotted to these four remote controls, provided that one and the same number should not be allotted to two or more remote controls.

As may be understood from the above, the length of the transmission permitting data frame is determined by multiplying the transmission unit of time TT by $2^{i-1}$; and the number of data present sub-sections DTa in the transmission permitting data frame STa of the repetitive period is determined to be $2^{i-1}$. A single repetitive period ST is determined as being composed of the so determined transmission permitting data frame STa plus the transmission preventing data frame STb of same time length. The sending of signals in these repetitive periods will assure that some signals in each channel appear inconsistent with those in the other channels.

Figures 11A, 11B, 11C, 11D, 11E:
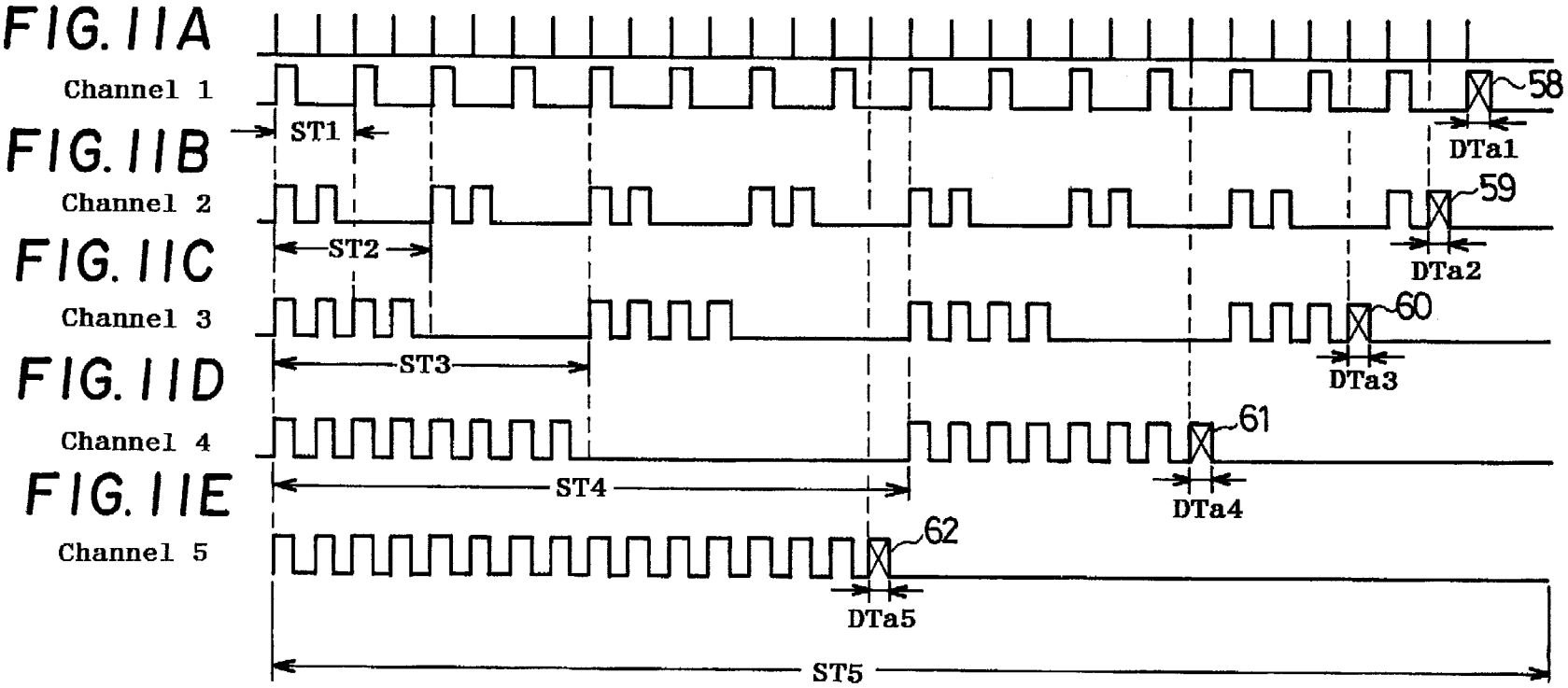
FIG. 11 shows time charts representing five simultaneous transmissions.

Referring to FIGS. 7 to 11, following the five examples show some data signals in each channel as appearing inconsistent with those in the other channels:

(1) all remote controls ("i"=1, 2, 3 and 4) start transmissions simultaneously (FIG. 7);

(2) one remote control ("i"=2) sends signals one half of the transmission unit of time TT later than the other remote controls (FIG. 8);

(3) one remote control ("i"=2) sends signals one transmission unit of time TT later than the other remote controls (FIG. 9);

(4) each of the second and subsequent remote controls sends signals one transmission unit of time TT later than the antecedent channel (FIG. 10); and (5) all remote controls ("i"=1, 2, 3, 4 and 5) start transmissions simultaneously (FIG. 11).

(1) All remote controls ("i"=1, 2, 3 and 4) start transmissions simultaneously:

Assume that four people operates their remote controls simultaneously. This is quite a rare occasion, and even in this rare occasion data can be derived from each channel.

Referring to FIG. 7, all remote controls starts transmissions simultaneously, and then, data signals of a selected channel in a selected transmission unit of time TT is not interfered with those of the other channels, as for instance follows:

data signals 42 of Channel 1 do not interfered with those of the other channels; data signals 43 of Channel 2 do not interfered with those of the other channels; data signals 44 of Channel 3 do not interfered with those of the other channels; and data signals 45 of Channel 4 do not interfered with those of the other channels.

Specifically, an interference-free data present sub-section DTa1 appears in the 8th period ST1 in Channel 1; an interference-free data present sub-section DTa2-2 appears in the 4th period ST2 in Channel 2; an interference-free data present sub-section DTa3-4 appears in the 2nd period ST3 in Channel 3; and an interference-free data present sub-section DTa4-8 appears in the 1st period ST4 in Channel 4. These interference-free data signals will be received by the single receiver.

(2) One remote control ("i"=2) sends signals one half of the transmission unit of time TT later than the other remote controls:

Referring to FIG. 8, in each channel the data present sub-section DTa is set to be equal to the data absent sub-section DTb (DTa=Dtb), and the transmission permitting data frame STa is set to be equal to the transmission preventing data frame STb (STa=STb). As seen from the drawing, the data present sub-sections DTa2 in Channel 2 appear every other data-free length of time in Channel 1.

All remote controls 1 to 4 send signals simultaneously, and therefore, the data absent sub-sections DTb in Channels 1, 3 and 4 appear concurrently with the data present sub-sections DTa2 in Channel 2 with the result that all signals 47*a* to 47*h* in Channel 2 cannot interfere with signals in the other channels, and that all signals 47*a* to 47*h* in Channel 2 can be received on the receiving side.

As seen from FIG. 8, free of interference are: the signals 46*a* and 46*b* of the data present sub-sections DTa1 in the 7th and 8th repetitive periods ST1 in Channel 1; the signal 48 of the 4th data present sub-sections DTa3 in the 2nd repetitive period ST3 in Channel 3; and the signal 49 of the 8th data present sub-sections DTa4 in the 1st repetitive period ST4 in Channel 4.

(3) One remote control ("i"=2) sends signals one transmission unit of time later than those in the other remote controls:

Referring to FIG. 9, the data present sub-section DTa is set to be equal to the data absent sub-section DTb (DTa=Dtb), and the transmission permitting data frame STa is set to be equal to the transmission preventing data frame STb (STa=STb). As seen from the drawing, the remote controls 1, 3 and 4 send signals simultaneously, but the remote control 2 sends signals one transmission unit of time later than those in the other remote controls.

As seen from FIG. 9, free of interference are: the signal 50 of the data present sub-section DTa1 in the 7th repetitive period ST1 in Channel 1; the signal 51 of the 1st data present sub-section DTa2 in the 4th repetitive period ST2 in Channel 2; the signal 52 of the 4th data present sub-section DTa3 in the 2nd repetitive period ST3 in Channel 3; and the signal 53 of the 8th data present sub-section DTa4 in the 1st repetitive period ST4 in Channel 4.

(4) Each of the second and subsequent remote controls sends signals one transmission unit of time later than the antecedent remote controls:

Referring to FIG. 10, each of the second, third and fourth remote controls 2, 3 and 4 send signals one transmission unit of time later than the antecedent remote control.

As seen from FIG. 10, free of interference are: the signal 54 of the data present sub-section DTa1 in the 1st repetitive period ST1 in Channel 1; the signal 55 of the 1st data present sub-section DTa2 in the 1st repetitive period ST2 in Channel 2; the signal 58 of the 2nd data present sub-section DTa3 in the 2nd repetitive period ST3 in Channel 3; and the signal 57 of the 5th data present sub-section DTa4 in the 1st repetitive period ST4 in Channel 4.

(5) All remote controls ("i"=1, 2, 3, 4 and 5) start transmission simultaneously:

The first remote control has a proper number "1" allotted thereto, sending signals in each data present sub-section DTa1 appearing once in each repetitive period ST1 of two transmission units of time (TT×2); the second remote control has a proper number "2" allotted thereto, sending signals in each data present sub-section DTa2 appearing twice in each repetitive period ST2 of four transmission units of time (TT×4); the third remote control has a proper number "3" allotted thereto, sending signals in each data present sub-section DTa3 appearing four times in each repetitive period ST3 of eight transmission units of time (TT×8); the fourth remote control has a proper number "4" allotted thereto, sending signals in each data present sub-section DTa4 appearing eight times in each repetitive period ST4 of sixteen transmission units of time (TT×16); and the fifth remote control has a proper number "5" allotted thereto, sending signals in each data present sub-section DTa5 appearing sixteen times in each repetitive period ST5 of thirty-two transmission units of time (TT×32).

As seen from FIG. 11, free of interference are: the signal 58 of the data present sub-section DTa1 in the 16th repetitive period ST1 in Channel 1; the signal 59 of the 2nd data present sub-section DTa2 in the 8th repetitive period ST2 in Channel 2; the signal 60 of the 4th data present sub-section DTa3 in the 4th repetitive period ST3 in Channel 3; the signal 61 of the 8th data present sub-section DTa4 in the 2nd repetitive period ST4 in Channel 4; and the signal 62 of the 16th data present sub-section DTa5 in the 1st repetitive period ST5 in Channel 5.

As may be understood from the above, no matter how many remote controls may be used, each remote control can have data present sub-sections free of interference in transmission in its channel.

In these particular embodiments remote controls are described as using the infrared rays, but radio frequency remote controls, ultrasonic remote controls or bus type wired remote controls can be equally used.

We claim:

1. A method of transmitting and receiving signals between a plurality of remote controls and a single receiver comprising the steps of:

repeatedly sending a transmission signal for a period ST;

composing each period of a transmission permitting data frame STa and a transmission preventing data frame STb, wherein the transmission permitting data frame STa having a time period which is equal to or shorter than a time period for the transmission preventing data frame STb (STa≦STb);

composing each transmission permitting data frame STa of a transmission unit of time TT times $2^{i-1}$, where "i" is a positive integer which is different for each remote control or channel; and composing each transmission unit of time TT of a data-present sub-section DTa and data-absent sub-section DTb, and wherein the data-present sub-section DTa having a time period which is equal to or shorter than a time period for the data-absent sub-section DTb (DTa≦DTb).

2. A method of transmitting and receiving according to claim 1, wherein the time period for the transmission permitting data frame STa is equal to the time period for the transmission prevention data frame STb (STa=STb).

3. A method of transmitting and receiving according to claim 1, wherein the time period for the data-present sub-section DTa is equal to the time period for the data-absent sub-section DTb (DTa=DTb).

4. A method of transmitting and receiving according to claim 1, 2 or 3, further comprising the step of selecting a number allotted to each remote control "i" among possible smallest numbers.

* * * * *